US006923252B2

(12) United States Patent
Skalski et al.

(10) Patent No.: US 6,923,252 B2
(45) Date of Patent: Aug. 2, 2005

(54) BOREHOLE SOUNDING DEVICE WITH SEALED DEPTH AND WATER LEVEL SENSORS

(75) Inventors: Joseph C. Skalski, Los Alamos, NM (US); Michael D. Henke, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 193 days.

(21) Appl. No.: 10/417,971

(22) Filed: Apr. 17, 2003

(65) Prior Publication Data

US 2004/0206492 A1 Oct. 21, 2004

(51) Int. Cl.[7] ..... E21B 29/02
(52) U.S. Cl. ..... 166/66; 73/152.54
(58) Field of Search ..... 166/66, 250.01, 166/250.03; 73/152.54, 152.55, 152.56

(56) References Cited

U.S. PATENT DOCUMENTS 2,776,563 A * 1/1957 Holbert ..... 324/324
3,477,920 A * 11/1969 Lerner ..... 73/292
6,502,634 B1 * 1/2003 Evans et al. ..... 166/250.03

* cited by examiner

*Primary Examiner*—Hoang Dang
(74) *Attorney, Agent, or Firm*—Milton D. Wyrick; Mark N. Fitzgerald

(57) ABSTRACT

A borehole device having proximal and distal ends comprises an enclosure at the proximal end for accepting an aircraft cable containing a plurality of insulated conductors from a remote position. A water sensing enclosure is sealingly attached to the enclosure and contains means for detecting water, and sending a signal on the cable to the remote position indicating water has been detected. A bottom sensing enclosure is sealingly attached to the water sensing enclosure for determining when the borehole device encounters borehole bottom and sends a signal on the cable to the remote position indicating that borehole bottom has been encountered.

5 Claims, 2 Drawing Sheets

Section "A" - "A"

Section "A" - "A"

BOREHOLE SOUNDING DEVICE WITH SEALED DEPTH AND WATER LEVEL SENSORS

The present invention generally relates to well drilling and servicing apparatus, and, more specifically, to borehole investigation equipment. This invention was made with Government support under Contract No. W-7405-ENG-36 awarded by the U.S. Department of Energy. The Government has certain rights in the invention.

BACKGROUND OF THE INVENTION

The oilwell industry utilizes borehole-sounding devices to investigate conditions in the drilled borehole. These conditions include well depth and/or the presence or level of water. Present borehole tools are designed to detect either the presence or level of water or measure borehole depth, but not both parameters simultaneously. This is due to design factors associated with these types of tools that prevent use as a combined tool. Two separate borehole loggings are required should both parameters need to be measured.

The cabling to connect most commercial logging tools is a flat, antenna type wire that has delicate insulation and wire conductors. In the harsh conditions existing in boreholes, this insulation often is easily cut or abraded on the well casing joints or on the upper edges of the casing. These harsh conditions can also cause breaking of the wires. In some cases, this wire breakage results in the logging tool being lost down the hole and can require expensive retrieval operations to recover the tool.

With commercial water level sensing tools, leakage is a common problem, allowing water to enter the internal areas of the tool where electrical connections are made. This wetting of the connections can cause the tool to render erroneous readings, and to corrode or otherwise foul the electrical connections. After use, a leaking tool must be disassembled, dried, and then reassembled. Often, the electrical contacts are difficult to reach for cleaning purposes.

Most commercial, bottom-sensing, logging tools use a mechanical sensing switch that, after a period of time, fails due to repeated exposure to water that leaks into the internal spaces of the tool. In addition, the mechanical sensing switch is normally a tight-fitting, sliding, hole-bottom contact that is adversely affected by mud or very dirty water in the borehole.

The present invention provides a multipurpose well-logging tool that provides both water sensing and bottom sensing capabilities in one logging tool. It is capable of performing both functions while overcoming many of the problems associated with other tools of this type.

The present invention provides a watertight borehole tool having sensors for both borehole depth and water presence and level, and replaces individual borehole tools for each function. This results in significant savings in both time and money since a single borehole logging can provide information on several conditions within the borehole.

Additional advantages and novel features of the invention will be set forth in part in the description which follows, and in part will become apparent to those skilled in the art. The advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, a borehole device having proximal and distal ends comprises an enclosure at the proximal end for accepting a cable containing a plurality of insulated conductors from a remote position. A water sensing enclosure is sealingly attached to the enclosure and contains means for detecting water, and sending a signal on the cable to the remote position indicating water has been detected. A bottom sensing enclosure is sealingly attached to the water sensing enclosure for determining when the borehole device encounters borehole bottom and sends a signal on the cable to the remote position indicating that borehole bottom has been encountered.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION

The present invention provides a multi-purpose logging tool that combines a bottom sensor with a water sensor in a watertight enclosure. The invention can be understood most easily through reference to the drawings.

Figure 1A:
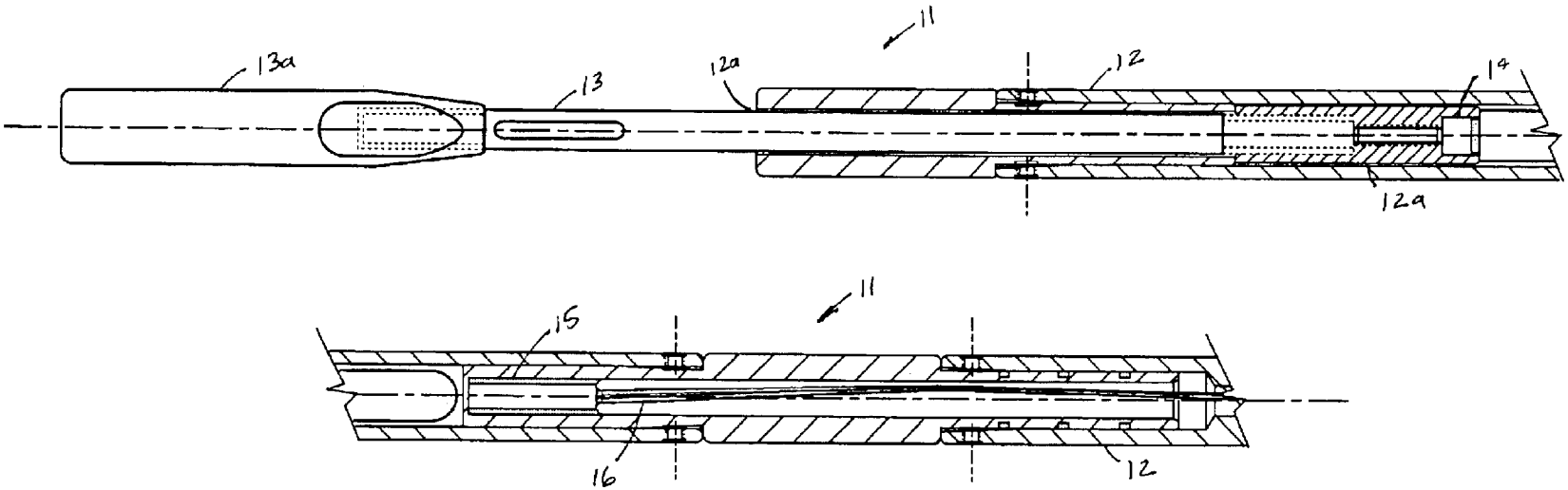
FIGS. 1A–1C are cross-sectional illustrations of components of the present invention.

In FIG. 1A, there can be seen a segmented cross-sectional illustration of bottom section 11 of borehole tool 10. Here is shown an embodiment of the present invention involving casing 12 that contains bottom sensing probe 13, which sealingly slides in interior 12*a* of casing 12. When the bottom of a well is encountered by bottom section 11, head 13*a* of bottom sensing probe 13 moves upward in interior 12*a* of casing 12. Permanent magnet 14 is attached to the end of bottom sensing probe, and as bottom sensing probe 13 moves in interior 12*a* of borehole tool 10 it encounters magnetic switch 15, which closes and sends a signal to the surface through cable 16 that the bottom of the well has been reached. Magnetic switch 15 is installed in an O-ring sealed cavity in bottom section 11 as shown in FIG. 1A. Cable 16 preferably is an aircraft-type cable with four internal insulated conductors, although other sturdy and appropriate cables could be used according to the intended application.

The bottom sensing ability of the present invention, contained within bottom section 11 of borehole tool 10 is clearly superior to the prior art in that magnetic switch 15 is never exposed to water in the borehole as it is installed in the O-ring sealed cavity inside bottom section 11. The fact that the bottom sensing operation uses a magnetically operated switch further provides for the reliability of the bottom sensing operation of the present invention.

Figure 1B:
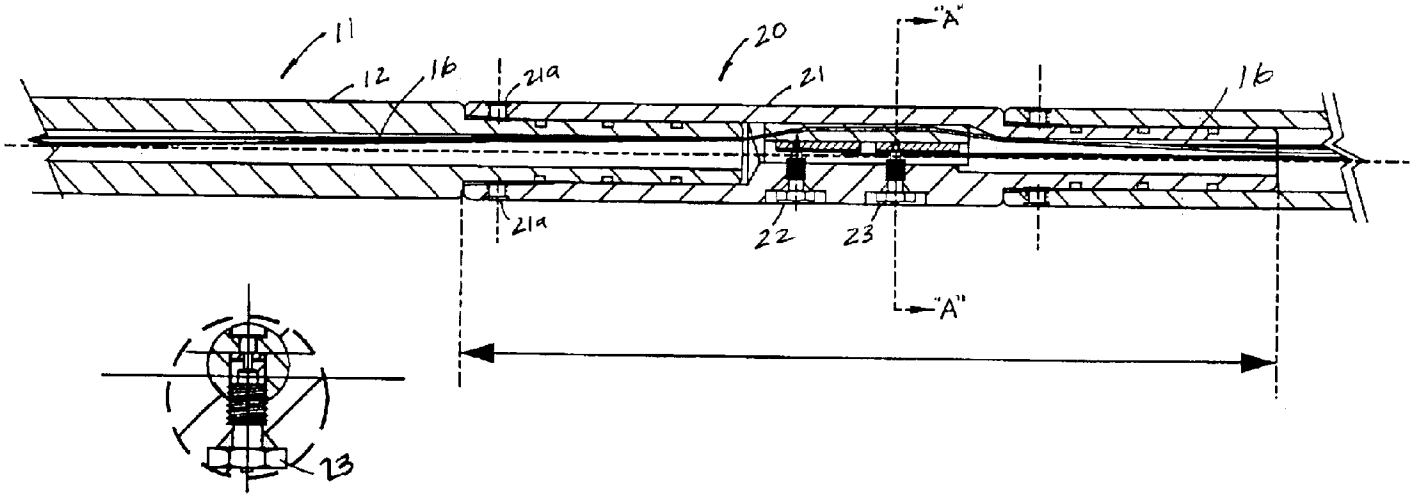

Referring now to FIG. 1B, the central section 20 of borehole tool 10 is illustrated in cross-section. As shown, bottom section 11 sealingly mates with casing 21 of central section 20, and is secured by setscrews 21*a*. Water sensors 22, 23 are located in central section 20 so that water sensor 22, 23 contacts are on the outside of central section 20, and are installed from outside bottom section 11 into threaded recesses so that they do not protrude beyond the surface of bottom section 11. The threaded recesses are sealed with O-rings and contain electrical receptacles for mating with electrical contacts on water sensors 22, 23. When water overtakes water sensors 22, 23, the resistance between water sensors 22, 23 changes and indicates that condition to the surface through cable 16. Section "A"—"A" shows the position of water sensor 23 sealingly mounted in the threaded recesses of central section 20 and the electrical connection inside the sealed threaded cavity. Although not shown, water sensor 22 is mounted in the same manner.

The advantages of this type of water sensing with the present invention include the fact that the glass-to-metal seals and O-ring seals employed positively exclude water and any other fluid having pressures up to 1500 psi from entering bottom section 11 and reaching any of the electrical connections, cable 16, or any of the components of borehole tool 10. Also, because of the particular mounting process of water sensors 22, 23, the associated external electrical contacts can be cleaned easily should they become corroded or coated with mineral deposits or mud.

Figure 1C:
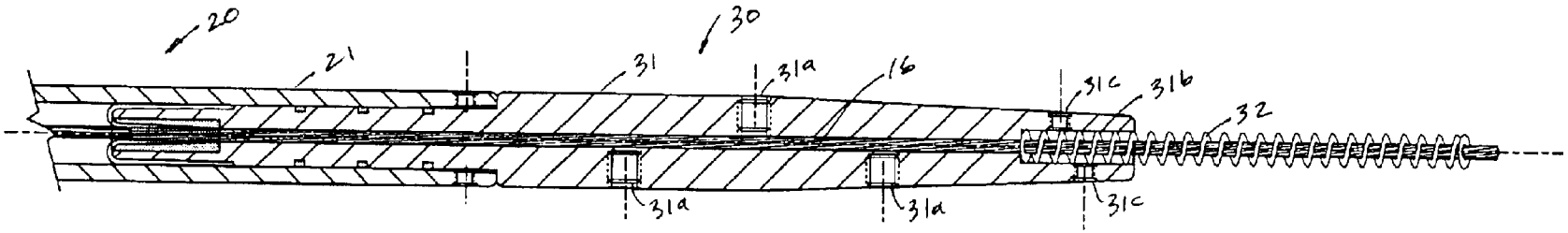

Reference should now be made to FIG. 1C, the top section 30 of borehole tool 10 is shown in cross-section. Here, central section 20 sealingly mates with casing 31 and is secured in place with setscrews 21*b*. As seen, cable 16 continues through borehole tool 10 and is secured within top section 30 by alternating setscrew. Load bearing wires 32 of cable 16 are seated in rope socket 31*b* and secured by setscrews 31*c*. To ensure that water or other fluids does not damage cable 16 or detract from the efficacious operation of borehole tool 10, cable 19 is potted into casing 31 using epoxy. The epoxy has a low viscosity, and easily fills the voids between individual cable strands, and the interior of casing 31. In addition to preventing fluids from entering the interior portions of casing 31, the potting provides additional strength to the load-bearing wires of cable 16 and casing 31.

As seen in the figures, the present invention employs modular construction techniques with O-ring sealing to allow easy repair or modification to be effected. Should additional functions be desired, they could be put into a matching enclosure and attached to the other enclosures using the O-ring and setscrew waterproof connections of the present invention. Similarly, necessary repairs can be made easily through disconnection of the enclosures.

The foregoing description of the embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A borehole device having proximal and distal ends comprising:

A sealed enclosure at said proximal end for accepting a cable containing a plurality of insulated conductors from a remote position;

a water sensing enclosure sealingly attached to said enclosure and containing means for detecting water, and sending a signal on said cable to said remote position indicating that water has been detected;

a bottom sensing enclosure sealingly attached to said water sensing enclosure for determining when said borehole device encounters borehole bottom and sending a signal on said cable to said remote position indicating that borehole bottom has been encountered.

2. The borehole device as described in claim 1 wherein said cable is aircraft-type cable with four internal insulated conductors.

3. The borehole device as described in claim 1 wherein said cable is epoxy potted into said enclosure to form a sealed connection.

4. The borehole device as described in claim 1 wherein said means for detecting water comprise a pair of electrodes sealingly mounted in said water sensing enclosure and connected to said cable.

5. The borehole device as described in claim 1 wherein said bottom sensing enclosure has an elongate projection having proximal and distal ends slidingly mounted in said bottom sensing enclosure, said proximal end being inside said bottom sensing enclosure and having a permanent magnet mounted thereto for interacting with a magnetic switch when said borehole bottom is encountered.

* * * * *